US006485294B2

(12) United States Patent
Riepenhoff et al.

(10) Patent No.: US 6,485,294 B2
(45) Date of Patent: Nov. 26, 2002

(54) NOX REDUCTION DEVICE

(75) Inventors: Matthew S. Riepenhoff, Flower Mound, TX (US); Glenn W. Kowald, Carrollton, TX (US); Randy D. Smith, Marshalltown, IA (US); Hugh E. Vinson, Hurst, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 0 days.

(21) Appl. No.: 09/742,053

(22) Filed: Dec. 20, 2000

(65) Prior Publication Data

US 2002/0076669 A1 Jun. 20, 2002

(51) Int. Cl.[7] ..... F23D 14/12; F23D 14/46; F24C 3/00; F24H 3/00

(52) U.S. Cl. ..... 431/347; 431/350; 431/354; 126/91 A; 126/116 A

(58) Field of Search ..... 431/354, 350, 431/347, 171, 353, 114; 126/91 A, 116 R, 116 A, 110 R

(56) References Cited

U.S. PATENT DOCUMENTS

| | | | | | |
|---|---|---|---|---|---|
| 1,654,403 | A | | 12/1927 | Blake | |
| 2,959,215 | A | | 11/1960 | Warnecke | |
| 3,799,732 | A | * | 3/1974 | Brodlin | 239/504 |
| 3,866,586 | A | * | 2/1975 | Scott, Jr. | 123/568.17 |
| 3,934,408 | A | * | 1/1976 | Irwin | 431/352 |
| 3,938,948 | A | | 2/1976 | Moore et al. | |
| 3,975,141 | A | * | 8/1976 | Sweet | 239/406 |
| 3,981,142 | A | * | 9/1976 | Irwin | 431/352 |
| 4,111,642 | A | * | 9/1978 | Kopp | 239/504 |
| 4,149,842 | A | * | 4/1979 | Benjamin | 239/425.5 |
| 4,276,018 | A | * | 6/1981 | Robbins | 431/352 |
| 4,776,320 | A | * | 10/1988 | Ripka et al. | 126/109 |
| 4,867,673 | A | | 9/1989 | Harrigill | |
| 5,083,917 | A | | 1/1992 | Mccullough et al. | |
| 5,236,327 | A | | 8/1993 | Flanagan et al. | |
| 5,240,411 | A | * | 8/1993 | Abalos | 126/92 AC |
| 5,244,381 | A | | 9/1993 | Cahlik | |
| 5,333,597 | A | * | 8/1994 | Kirkpatrick et al. | 126/110 R |
| 5,370,529 | A | * | 12/1994 | Lu et al. | 431/353 |
| 5,472,339 | A | | 12/1995 | Rakowski et al. | |
| 5,546,925 | A | * | 8/1996 | Knight et al. | 126/110 R |
| 5,580,238 | A | * | 12/1996 | Charles, Sr. et al. | 431/114 |
| 5,596,979 | A | * | 1/1997 | Sobotka et al. | 122/155.2 |
| 5,961,320 | A | | 10/1999 | Drago et al. | |
| 6,140,658 | A | * | 10/2000 | Jarvinen | 250/495.1 |

FOREIGN PATENT DOCUMENTS

| | | | | |
|---|---|---|---|---|
| GB | 2066445 A | * | 7/1981 | F23D/11/40 |
| JP | 54144510 A | * | 11/1979 | F23R/1/08 |

OTHER PUBLICATIONS

Lennox Industries Drawings, Oct. 12, 1999.*

* cited by examiner

*Primary Examiner*—Henry Bennett
*Assistant Examiner*—Kathryn Ferko
(74) *Attorney, Agent, or Firm*—W. Kirk McCord

(57) ABSTRACT

In a gas-burning apparatus, such as a furnace, a device for reducing NOx emissions includes a cup member mounted proximate to an inlet to a combustion chamber of the apparatus and a perforate member attached to the cup member and located in the combustion chamber at a predetermined distance inwardly from the inlet. The perforate member has a plurality of holes to define a mesh pattern through which the flame and other products of combustion are constrained to pass within the combustion chamber. The perforate member acts as a heat sink to reduce the flame temperature, thereby inhibiting NOx production.

20 Claims, 3 Drawing Sheets

NOX REDUCTION DEVICE

TECHNICAL FIELD

This invention relates generally to gas-burning apparatus, such as furnaces, and in particular to a device for reducing NOx emissions in gas-burning apparatus.

BACKGROUND ART

The formation of nitrous oxide (NOx) occurs when nitrogen is oxidized during the burning of a gaseous fuel. The higher the flame temperature, the greater the amount of NOx that is produced by the burner flame. Air quality standards in some states (e.g., California) require that NOx emissions from gas furnaces not exceed 40 nanograms per Joule (ng/J).

Devices for reducing NOx emissions in a gas furnace are known in the art. Such devices typically include target or impingement plates, located just inside the combustion chamber in proximity to the furnace burner, for quenching the flame and reducing the temperature thereof. Devices of this type are shown in U.S. Pat. Nos. 5,244,381 and 5,961,320. Another type of NOx reduction device uses a baffle member located in a gas furnace combustion chamber, which enhances mixing between the flame and the secondary combustion air downstream of the baffle member, as shown in U.S. Pat. No 5,472,339.

SUMMARY OF THE INVENTION

In accordance with the present invention, a device for lowering NOx emissions from a gas-burning apparatus is provided. The apparatus has a combustion chamber with an inlet and an outlet, a burner proximate to the inlet for burning a combustible mixture of gas and primary combustion air to produce a relatively gas-rich flame, and a blower for drawing the gas-rich flame along with secondary combustion air into and through the combustion chamber. The device includes a perforate member located in the combustion chamber at a predetermined distance from the inlet thereof.

In accordance with a feature of the invention, the perforate member has a generally cylindrical configuration, which extends along the direction of flow of the flame in the combustion chamber a sufficient amount to ensure that the flame makes a plurality of passes through the perforate member as it is drawn through the combustion chamber. By ensuring such plurality of passes, the dwell time of the perforate member in the flame is sufficient to quench the flame and inhibit NOx production.

In accordance with another feature of the invention, the perforate member has a plurality of holes which are sized and spaced apart at sufficient distances to provide sufficient porosity to allow ample mixing of products of combustion, while still providing sufficient flame quenching.

In accordance with yet another feature of the invention, the perforate member is attached to a cup member by means of at least one elongated mounting arm. The cup member is located proximate to the inlet of the combustion chamber and is tapered inwardly toward the perforate member to enhance mixing between the gas-rich flame and the secondary combustion air and to direct the flame down the center of the combustion chamber in the direction of the perforate member.

In accordance with a preferred embodiment of the invention, the perforate member is located in the combustion chamber about two inches inwardly from an innermost edge of the cup member and has a length of about 1.375 inches along the combustion chamber. The perforate member preferably has a diameter of about one inch. Each of the holes in the perforate member preferably has a diameter of about 0.125 inch and the holes are spaced apart at intervals of approximately 0.188 inch.

In operation, the gas-rich flame produced by the burner is drawn into the combustion chamber along with secondary combustion air. The tapered configuration of the cup member mixes the secondary combustion air with the gas-rich flame to provide a relatively compact flame near the center of the combustion chamber. When the flame encounters the perforate member, it makes multiple passes therethrough, whereby turbulence is increased to enhance mixing of the products of combustion. The perforate member also acts as a heat sink to reduce the temperature of the flame and inhibit NOx production.

BEST MODE FOR CARRYING OUT THE INVENTION

Figure 1:
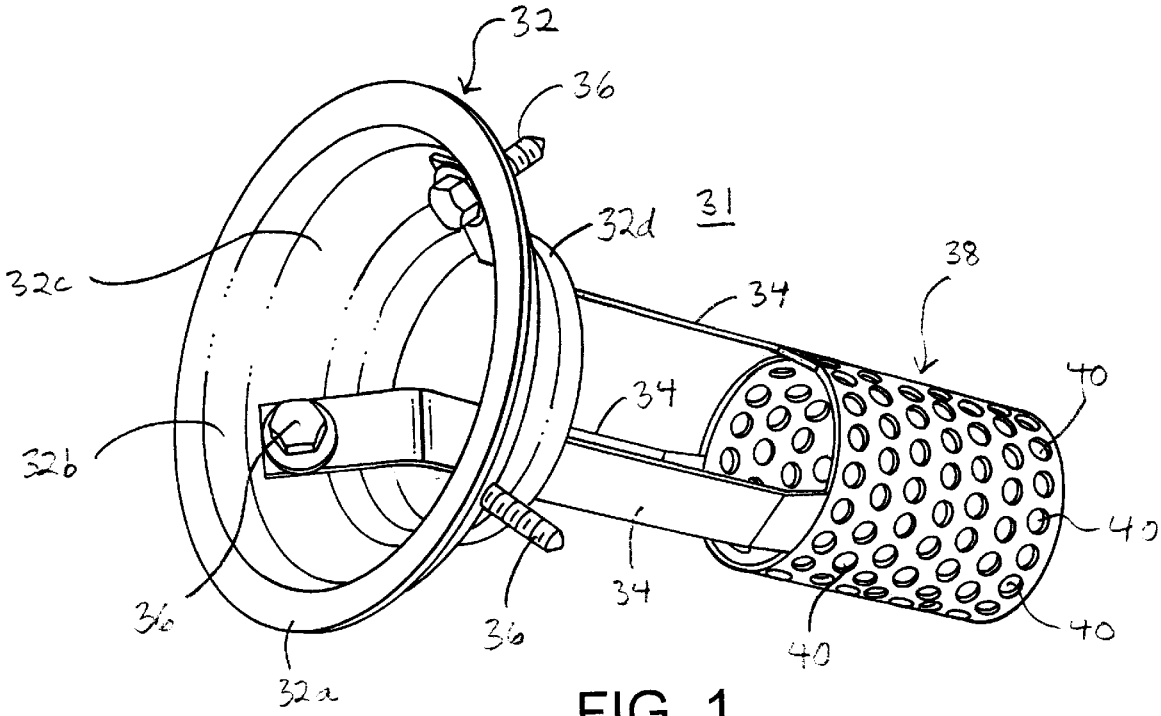
FIG. 1 is a perspective view of a device for reducing NOx emissions from a gas furnace, according to the present invention.
Figure 2:
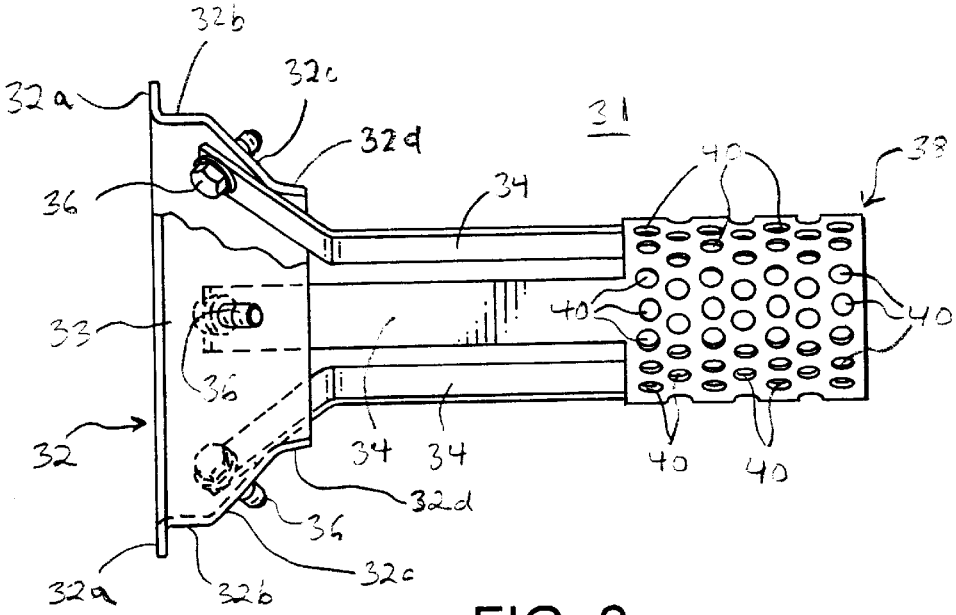
FIG. 2 is a side view of the device of FIG. 1.

The best mode for carrying out the invention is described hereinbelow with reference to the accompanying drawings. Like parts are marked throughout the specification and drawings with the same respective reference numbers. The drawings are not necessarily to scale and in some instances proportions may have been exaggerated in order to more clearly depict certain features of the invention.

Referring to FIGS. 1–5, an inshot burner 10 and combustion chamber 12 of a gas furnace 13 are depicted. Burner 10 includes a flared inlet end 14 and a hollowed body portion 16 in the shape of a truncated cone, the apex of which is proximate to inlet end 14 and the base of which defines an outlet end 18 of burner 10.

Inlet end 14 is in communication with a source (not shown) of combustible gas and primary combustion air. A combustible mixture of gas (e.g., natural gas) and primary combustion air enters burner 10 at inlet 14 and exits burner 10 at outlet 18. A conventional ignitor, such as a spark ignitor (not shown), ignites the combustible gas-air mixture emanating from outlet end 18 in a gap 20 between outlet end 18 and an inlet 22 of combustion chamber 12.

Figure 5:
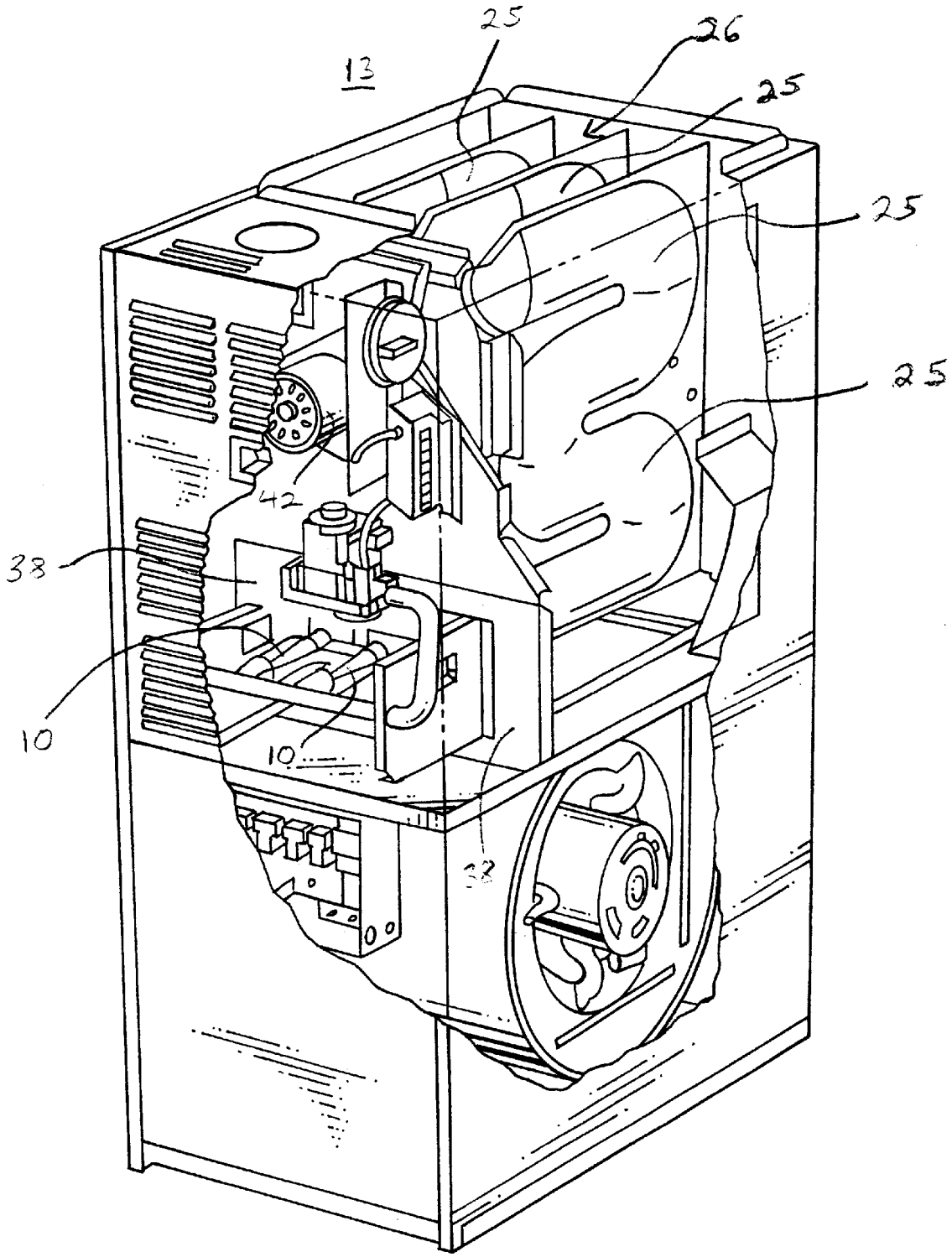
FIG. 5 is a perspective, partial cutaway view of the gas furnace containing the NOx reduction device of the present invention.

Combustion chamber 12 is defined by a wall 24. Wall 24 has a flange portion 24*a* at inlet 22 and a tapered portion 24*b* extending inwardly from inlet 22. Tapered portion 24*b* defines combustion chamber 12. Inwardly from tapered portion 24*b*, wall 24 defines a serpentine passage 25 of a clamshell heat exchanger 26, as shown in FIG. 5. As also shown in FIG. 5, furnace 13 preferably has plural burners 10 of the type described hereinabove, which are operatively associated with respective plural combustion chambers 12 of the type described hereinabove. Heat exchanger 26 therefore includes plural serpentine passages 25 defined by respective walls 24. Each serpentine passage 25 provides a discrete flow passage of products of combustion through heat exchanger 26.

Figure 3:
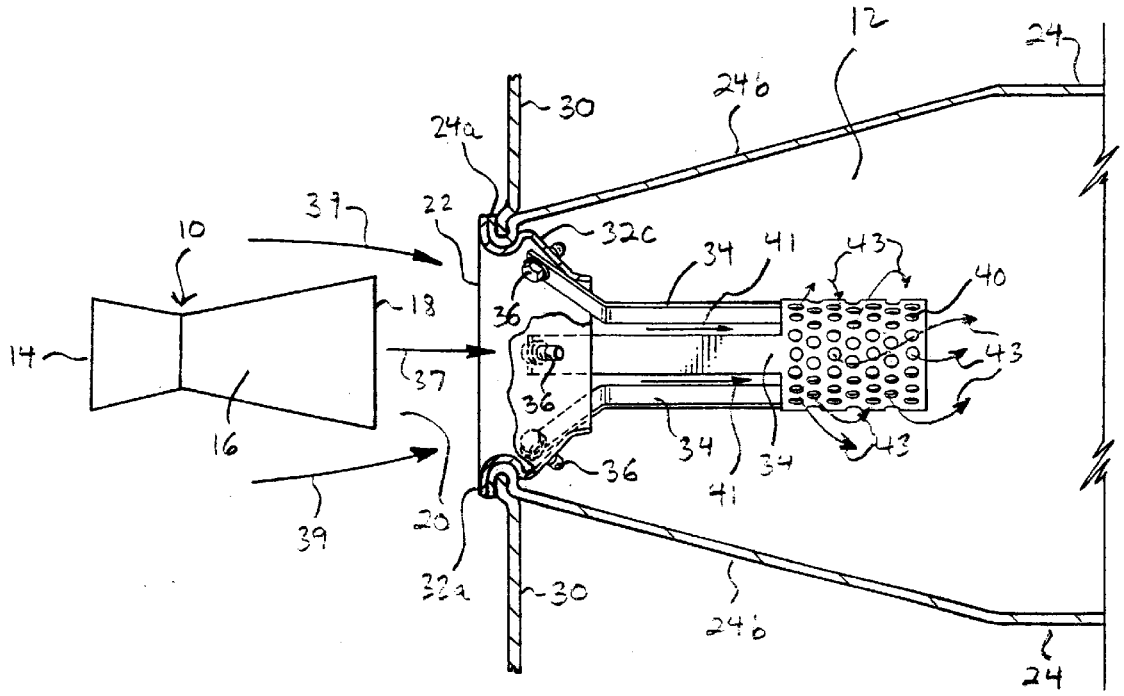
FIG. 3 is a side sectional view of a gas furnace burner and combustion chamber, with the device of FIG. 1 positioned in the combustion chamber, illustrating the operation of the device.
Figure 4:
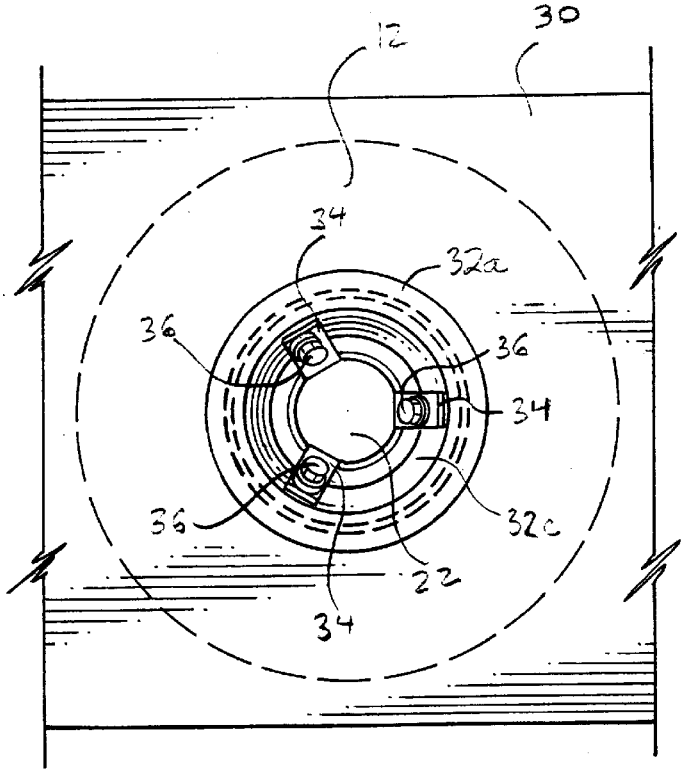
FIG. 4 is an external front elevation view of the furnace vestibule panel, looking into the combustion chamber, with the device of FIG. 1 positioned therein.

Flange portion 24*a* is folded to provide a recess, wherein a vestibule panel 30 is received, as shown in FIG. 3. Vestibule panel 30 provides support for heat exchanger 26 in the conventional manner. As can be best seen in FIG. 1, a device 31 for reducing NOx emissions is comprised of a cup member 32, three elongated mounting arms 34 and a perforate member 38. Cup member 32 is located proximate to inlet 22 and includes an annular portion 32*a*, which overlaps flange portion 24*a* and is in contact therewith. Cup member 32 has a generally circular central opening 33, which is circumscribed by annular portion 32*a*. Opening 33 defines inlet 22. Cup member 32 is preferably a corbel cup manufactured from aluminized steel. Cup member 32 further includes a first generally cylindrical portion 32*b*, an inwardly tapered portion 32*c* and a second generally cylindrical portion 32*d*, which defines an innermost portion of cup member 32. Portion 32*b* is swaged into pressure contact with flange portion 24*a*, to secure cup member 32 to wall 24. Three elongated mounting arms 34 are attached to tapered portion 32*c* at respective first ends of arms 34 by respective three threaded attachment numbers 36 (e.g., screws or threaded bolts).

Depending from mounting arms 34 at respective second ends thereof, opposite from the respective first ends thereof, is a perforate member 38. Perforate member 38 is preferably made of stainless steel and includes a plurality of holes 40, such that perforate member 38 defines a mesh. Each of the holes 40 has a diameter of about 0.125 inch and the spacing from center to center of adjacent holes 40 is about 0.188 inch. Perforate member 38 has a length along combustion chamber 12 of about 1.375 inches and a diameter of about one inch. Perforate member 38 is positioned within combustion chamber 12, such that perforate member 38 is substantially immersed in the flame within combustion chamber 12 when furnace 13 is in operation. Each mounting arm 34 has a length, such that perforate member 38 is located in combustion chamber 12 approximately two inches from cup member 32. The mesh defined by holes 40 in perforate member 38 provides a porosity of about 32%, which allows the flame and products of combustion to pass through perforate member 38.

The steel material of perforate member 38 acts as a heat sink when it is immersed in the flame in combustion chamber 12, to reduce the temperature of the flame and inhibit NOx production. The length of perforate member 38 in the direction of flow of the products of combustion in combustion chamber 12 is sufficient to constrain the products of combustion to make multiple passes through the mesh of perforate member 38, as shown in FIG. 3, thereby enhancing mixing of the products of combustion and combustion of the gaseous fuel to inhibit carbon monoxide production.

In operation, gaseous fuel and primary combustion air are burned by burner 10 at a relatively low temperature, thereby inhibiting NOx production. As shown in FIG. 3, the gas-rich flame, as indicated by arrows 37, enters combustion chamber 12 through cup member 32 and mixes with secondary combustion air in cup member 32, as indicated by arrows 39, to provide more complete combustion of the gaseous fuel. Tapered portion 32*c* channels the flame towards the center of combustion chamber 12 in the direction of perforate member 38, as indicated by arrows 41. Perforate member 38 is positioned so that it is immersed in substantially the hottest part of the flame and the mesh pattern comprising perforate member 38 causes the flame and products of combustion to make multiple passes through perforate member 38, as indicated by arrows 43, thereby increasing the turbulence of the flame and the products of combustion to provide better mixing and to facilitate complete combustion of the fuel, whereby carbon monoxide production is inhibited. Further, by constraining the flame and products of combustion to make multiple passes through perforate member 38, perforate member 38 helps to quench the flame and inhibit the production of NOx.

Products of combustion are drawn through each combustion chamber 12 and serpentine passageway 25 of heat exchanger 26 by an air mover, such as an induced draft blower 42 (FIG. 5) to heat air passing over the outside of heat exchanger 26 in the conventional manner. The products of combustion are exhausted from furnace 13 in the conventional manner through a vent pipe (not shown).

The effectiveness of NOx reduction device 31 has been determined through empirical testing, which has consistently shown NOx emissions below the 40 ng/J threshold in furnaces in which device 31 is used.

The best mode for carrying out the invention has now been described in detail. Since changes in and additions to the above-described best mode may be made without departing from the nature, spirit and scope of the invention, the invention is not to be limited to the above-described best mode, but only by the appended claims and their proper equivalents.

What is claimed is:

1. In a gas-burning apparatus having a combustion chamber with an inlet and an outlet, a burner spaced from and aligned with the inlet for burning a combustible mixture of gas and air to produce a flame and other products of combustion, and an air mover for drawing the flame and other products of combustion into and through the combustion chamber, a device for reducing NOx emissions from the apparatus, said device comprising a perforate member located in the combustion chamber and having a plurality of holes therein to allow the flame and other products of combustion to pass through said perforate member, said device further including a cup member mounted proximate to the inlet and an attachment member attached at one end thereof to said perforate member and at an opposite end thereof to said cup member, said perforate member being spaced at a predetermined distance from said cup member inwardly along a longitudinal axis of the combustion chamber between the inlet and the outlet.

2. The device of claim 1 wherein said cup member is tapered in a direction from the inlet toward said: perforate member, whereby said cup member is operable to direct the flame and other products of combustion toward said perforate member.

3. The device of claim 1 wherein said attachment member includes at least one elongated arm member extending between said cup member and said perforate member, said arm member having a length corresponding to said predetermined distance.

4. The device of claim 1 wherein said perforate member has a generally cylindrical configuration and extends along the longitudinal axis of the combustion chamber a distance sufficient to cause the flame and other products of combustion to make a plurality of passes through said perforate member.

5. The device of claim 1 wherein each of the holes of said perforate member is generally circular with a diameter of about 0.125 inch.

6. The device of claim 1 wherein said holes are spaced at intervals of about 0.188 inch, as measured from a center of each hole.

7. The device of claim 1 wherein said perforate member has a length along the longitudinal axis of the combustion chamber of about 1.375 inches.

8. The device of claim 1 wherein said attachment member includes plural elongated arm members extending between said cup member and said perforate member, each of said arm members having a length corresponding said predetermined distance.

9. In combination:

a gas-burning apparatus having a combustion chamber with an inlet and an outlet, a burner spaced from and aligned with the said inlet for burning a combustible mixture of gas and air to produce a flame and other products of combustion, and an air mover for drawing the flame and other products of combustion into and through said combustion chamber; and a device for reducing NOx emissions from said apparatus, said device comprising a perforate member located in said combustion chamber and having a plurality of holes therein to allow the flame and other products of combustion to pass through said perforate member, said device further including a cup member mounted proximate to said inlet and an attachment member attached at one end thereof to said perforate member and at an opposite end thereof to said cup member, said perforate member being spaced at a predetermined distance from said cup member inwardly along a longitudinal axis of said combustion chamber between said inlet and said outlet.

10. The combination of claim 9 wherein said cup member is tapered in a direction from said inlet toward said perforate member, whereby said cup member is operable to direct the flame and other products of combustion toward said perforate member.

11. The combination of claim 9 wherein said attachment member includes at least one elongated arm member extending between said cup member and said perforate member, said arm member having a length corresponding to said predetermined distance.

12. The combination of claim 9 wherein said apparatus is a furnace.

13. The combination of claim 9 wherein said air mover is a blower.

14. The combination of claim 9 wherein said perforate member has a generally cylindrical configuration and extends along said longitudinal axis a distance sufficient to cause the flame and other products of combustion to make multiple passes through said perforate member.

15. The combination of claim 9 wherein said attachment member includes plural elongated arm members extending between said cup member and said perforate member, each of said arm members having a length corresponding to said predetermined distance.

16. In a gas-burning apparatus having a combustion chamber with an inlet and an outlet, a burner spaced from and aligned with the inlet for burning a combustible mixture of gas and air to produce a flame and other products of combustion, and an air mover for drawing the flame and other products of combustion into and through the combustion chamber, a device for reducing NOx emissions from the apparatus, said device comprising a perforate member located in the combustion chamber and having a plurality of holes therein to allow the flame and other products of combustion to pass through said perforate member, said device further including a cup member mounted proximate to the inlet and an attachment member attached at one end thereof to said perforate member and at an opposite end thereof to said cup member, said perforate member being spaced at a predetermined distance from said cup member inwardly along a longitudinal axis of the combustion chamber between the inlet and the outlet, said cup member being tapered in a direction from the inlet toward said perforate member.

17. The device of claim 16 wherein said attachment member includes at least one elongated arm member extending between said cup member and said perforate member, said arm member having a length corresponding to said predetermined distance.

18. The device of claim 16 wherein said perforate member has a generally cylindrical configuration and extends along the longitudinal axis of the combustion chamber a distance sufficient to cause the flame and other products of combustion to make multiple passes through said perforate member.

19. The device of claim 16 wherein said attachment member includes plural elongated arm members extending between said cup member and said perforate member, each of said arm members having a length corresponding to said predetermined distance.

20. The device of claim 16 wherein said perforate member extends along the longitudinal axis of the combustion chamber a distance sufficient to cause the flame and other products of combustion to make a plurality of passes through said perforate member.

* * * * *